US005120208A

United States Patent [19]

Toyoshima et al.

[11] Patent Number: 5,120,208

[45] Date of Patent: Jun. 9, 1992

[54] MOLECULAR DRAG PUMP WITH ROTORS MOVING IN SAME DIRECTION

[75] Inventors: Takeshi Toyoshima, Ibaraki; Mitsuo Ogura, Katsuta, both of Japan

[73] Assignee: Hitachi Koki Company Limited, Tokyo, Japan

[21] Appl. No.: 599,853

[22] Filed: Oct. 19, 1990

[51] Int. Cl.[5] ..... F04C 2/14; F04C 18/14

[52] U.S. Cl. ..... 418/201.3; 418/202; 415/60

[58] Field of Search ..... 418/201.1, 201.2, 201.3, 418/200, 202, 220; 415/60, 90; 417/423.4

[56] References Cited

U.S. PATENT DOCUMENTS

| | | | |
|---|---|---|---|
| 1,991,541 | 2/1935 | Cannizzaro | 418/201.1 |
| 3,170,566 | 2/1965 | Zimmermann | 418/201.1 |
| 3,198,582 | 8/1985 | Zalis | 418/202 |
| 4,782,802 | 11/1988 | Koromilas | 418/197 |

FOREIGN PATENT DOCUMENTS

| | | | |
|---|---|---|---|
| 340685 | 11/1989 | European Pat. Off. . | |
| 109663 | 10/1917 | Fed. Rep. of Germany . | |
| 1160119 | 6/1985 | U.S.S.R. | 417/423.4 |

OTHER PUBLICATIONS

Patent Abstracts of Japan, vol. 13, No. 287 (M-844) (3635) Jun. 30, 1989 & JP-A-1 80786 (Hitachi) Mar. 27, 1989.

Patent Abstracts of Japan, vol. 12, No. 218 (M-711) (3065) Jun. 22, 1988 & JP-A-63 16185 (Mazda) Jan. 23, 1988.

*Primary Examiner*—Richard A. Bertsch
*Assistant Examiner*—David L. Cavanaugh
*Attorney, Agent, or Firm*—Pollock, VandeSande & Priddy

[57] ABSTRACT

A molecular drag pump for delivering a gas under molecular flow conditions comprises a pair of parallel, helically threaded rotors rotatably mounted in a stationary housing. The rotors have respective helical threads and respective helical grooves, and are held in close mesh with each other. The helical threads are helically inclined in one direction to the axes of the rotors, and have a flank angle such that the helical threads are closely received in the respective helical grooves while keeping the threads out of contact with each other. The rotors are rotated in one direction about their respective axes to move a gas introduced through an inlet port toward an exhaust port axially along the rotors.

1 Claim, 3 Drawing Sheets

MOLECULAR DRAG PUMP WITH ROTORS MOVING IN SAME DIRECTION

BACKGROUND OF THE INVENTION

1. Field of the Invention

The present invention relates to a molecular drag pump which operates to deliver a gas from the inlet side to the exhaust side under molecular flow conditions, and more particularly to a molecular drag pump composed of a pair of parallel, helically threaded intermeshing rotors for discharging a gas at high speed.

2. Prior Art

There are known various molecular drag pumps in the art. Among the known types of molecular drag pumps is a molecular drag pump which is composed of a pair of parallel, helically threaded rotors intermeshing with each other. Such a molecular drag pump is relatively simple in structure and can be manufactured with ease, but cannot discharge a gas at high speed.

More specifically, the molecular drag pump comprises two parallel intermeshing rotors which are helically threaded in opposite directions and rotatable about their respective axes also in opposite directions. One of the rotors has a right-hand helical rib or thread and a right-hand helical groove, whereas the other rotor has a left-hand helical rib or thread and a left-hand helical groove. These right- and left-hand threads are held in mesh with each other, i.e., positioned in the left- and right-hand grooves, respectively. Since the right-hand groove and the left-hand thread, and also the right-hand thread and the left-hand groove rotate in the same direction in the vicinity of the region where they mesh with each other, the gas delivered from the inlet port to the exhaust port by the helically threaded pump tends to leak from a radial gap which is defined between the meshing threads and grooves. Therefore, the conventional molecular drag pump with helically threaded rotors cannot discharge the gas at high speed.

SUMMARY OF THE INVENTION

In view of the aforesaid drawbacks of the conventional molecular drag pump with helically threaded rotors, it is an object of the present invention to provide a molecular drag pump having a pair of parallel, helically threaded rotors which intermesh with each other, for discharging a gas at high speed.

According to the present invention, a molecular drag pump for delivering a gas under molecular flow conditions comprises a stationary housing having an inlet port and an exhaust port, a pair of first and second rotors rotatably disposed in the stationary housing, the first and second rotors being rotatable about respective axes extending parallel to each other, the first and second rotors having respective first and second helical threads and respective first and second helical grooves, which are helically inclined to the axes in one direction, the first and second rotors being held in mesh with each other with the first and second helical threads being received in the second and first grooves, respectively, the first and second helical threads having a flank angle such that the first and second helical threads are closely received in the second and first grooves while keeping the first and second threads out of contact with each other. An actuating mechanism is disposed in the housing for rotating the first and second rotors in one direction about respective axes thereof to move a gas introduced through the inlet port toward the exhaust port axially along the first and second rotors.

The actuating mechanism comprises a motor for rotating the first rotor, a first gear coaxially coupled to the first rotor, a second gear coaxially coupled to the second rotor, and a third rotor held in mesh with the first and second gear.

The above and other objects, features and advantages of the present invention will become more apparent from the following description when taken in conjunction with the accompanying drawings in which a preferred embodiment of the present invention is shown by way of illustrative example.

DETAILED DESCRIPTION

Figure 1:
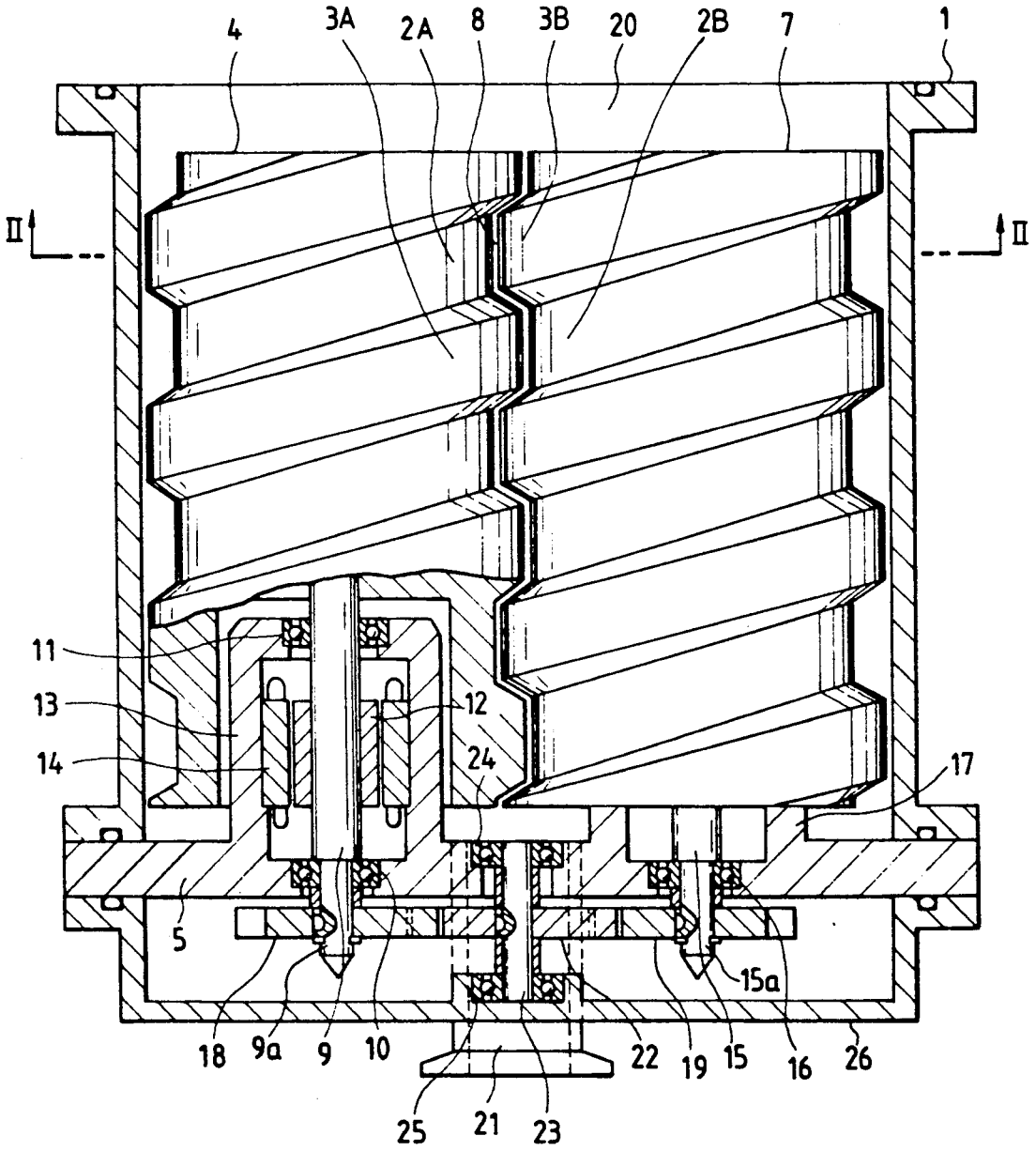
FIG. 1 is an axial cross-sectional view of a molecular drag pump with a pair of parallel, helically threaded, intermeshing rotors according to the present invention.
Figure 2:
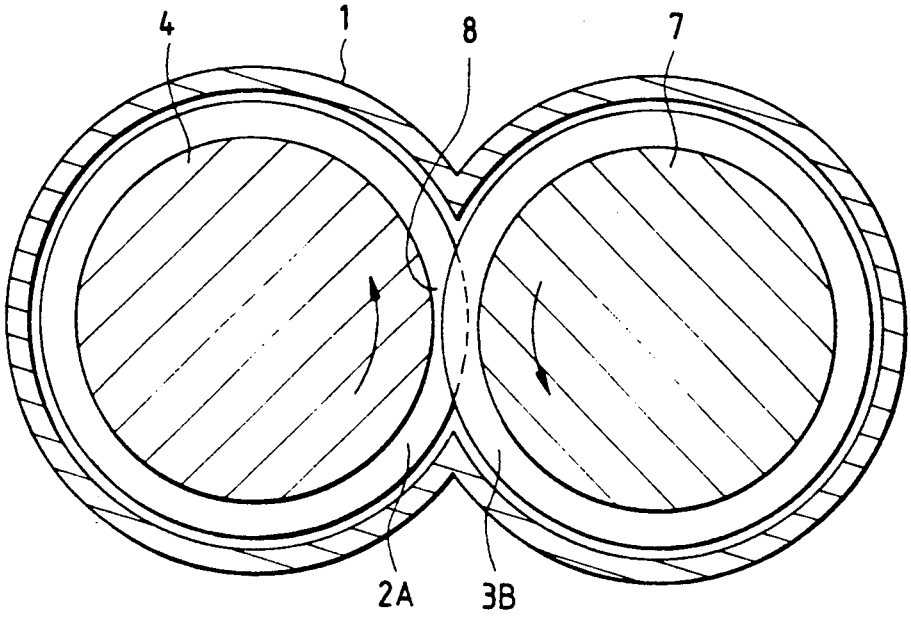
FIG. 2 is a cross-sectional view taken along line II—II of FIG. 1.

FIGS. 1 and 2 show a molecular drag pump according to the present invention. As shown in FIGS. 1 and 2, the molecular drag pump comprises a stationary housing 1 having an 8-shaped cross section, and a pair of parallel, helically threaded rotors 4, 7 rotatably mounted in the housing 1. The rotor 4, which is located on the left-hand side in the housing 1, has a right-hand helical groove 2A defined in an outer circumferential surface and a right-hand helical rib or thread 3A on the outer circumferential surface. The rotor 7, which is located on the right-hand side in the housing 1, has a right-hand helical groove 2B defined in an outer circumferential surface thereof and a right-hand helical rib or thread 3B on the outer circumferential surface. The helically threaded rotors 4, 7 are held in interdigitating mesh with each other such that a radial gap or clearance 8 between the crest surfaces of the threads 3A, 3B and the bottom surfaces of the grooves 2A, 2B which receive the threads 3A, 3B is as small as possible. The rotors 4, 7 are rotatable about their own axes which extend parallel to each other.

The rotor 4 has a shaft 9 which is rotatably supported by ball bearings 10, 11 on a hollow base 13 extending from a frame 5 which is fixedly mounted in the housing 1. The shaft 9 supports thereon a motor rotor 12 positioned in the hollow base 13, and the hollow base 13 supports on its inner surface a motor stator 14 in surrounding relation to the motor rotor 12.

Likewise, the rotor 7 has a shaft 15 which is rotatably supported by ball bearings 16 (one shown) on a hollow base 17 extending from the frame 5. However, the shaft 15 does not support any motor rotor and the hollow base 17 does not support any motor stator.

The shafts 9, 15 have respective lower ends **9*a*, 15*a* (as shown in FIG. 1) projecting beyond the frame 5. Gears 18, 19 are fixedly mounted respectively on the projecting lower ends 9*a*, 15*a* of the shafts 9, 15. The gears 18, 19, which are of the same diameter as each other, are held in mesh with a common central gear 22 which is fixedly mounted on a central shaft 23. The central shaft 23 is rotatably supported at one end on the frame 5 by a ball bearing 24 and at the other end on the housing 1 by a ball bearing 25**.

The stationary housing 1 has an upper end opening serving as an inlet port 20 which is connected to a device (not shown) to be evacuated by the molecular drag pump. A gas which is discharged from the device enters the housing 1 through the inlet port 20, and is delivered by the rotors 4, 7 downwardly therealong, and finally discharged from the housing 1 through an exhaust port 21 which extends through the frame 5 and a lower end wall 26 of the housing 1, and opens toward the ends of the rotors 4, 7 at a position where they intermesh with each other.

The molecular drag pump of the above structure operates as follows:

First, an auxiliary pump such as a hydraulically operated pump is connected to the exhaust port 21 and actuated to lower the pressure in the housing 1 until molecular flow conditions are achieved in the housing 1. Then, the motor composed of the rotor 12 and the stator 14 is energized to rotate the shaft 9. The gears 18, 19 are rotated in the same direction at the same speed because they have the same diameter and they are held in mesh with the common central gear 22. Therefore, the rotors 4, 7 are rotated in the same direction about their own axes, i.e., the shafts 9, 15, respectively.

More specifically, if the rotor 4 rotates counterclockwise as shown in FIG. 2, then the rotor 7 also rotates counterclockwise. The gas which is drawn into the housing 1 through the inlet port 20 is introduced into the right-hand groove 2A and the right-hand groove 2B, and then displaced downwardly, i.e., toward the exhaust port 21. During this time, the gas in the right-hand groove 2A is forcibly delivered downwardly by the right-hand thread 3B, and the gas in the right-hand groove 2B is forcibly delivered downwardly by the right-hand thread 3A, upon rotation of the rotors 4, 7. As shown FIG. 2, the bottom surface of the right-hand groove 2A of the rotor 4 and the crest surface of the right-hand thread 3B of the rotor 7 rotate in the opposite directions in the vicinity of the radial gap 8 defined therebetween, and the crest surface of the right-hand thread 3B rotates at a higher peripheral speed than the peripheral speed at which the bottom surface of the right-hand groove 2A rotates. Accordingly, any leakage of the gas through the radial gap 8 is small, and the gas can be discharged from the molecular drag pump at high speed.

Figure 3:
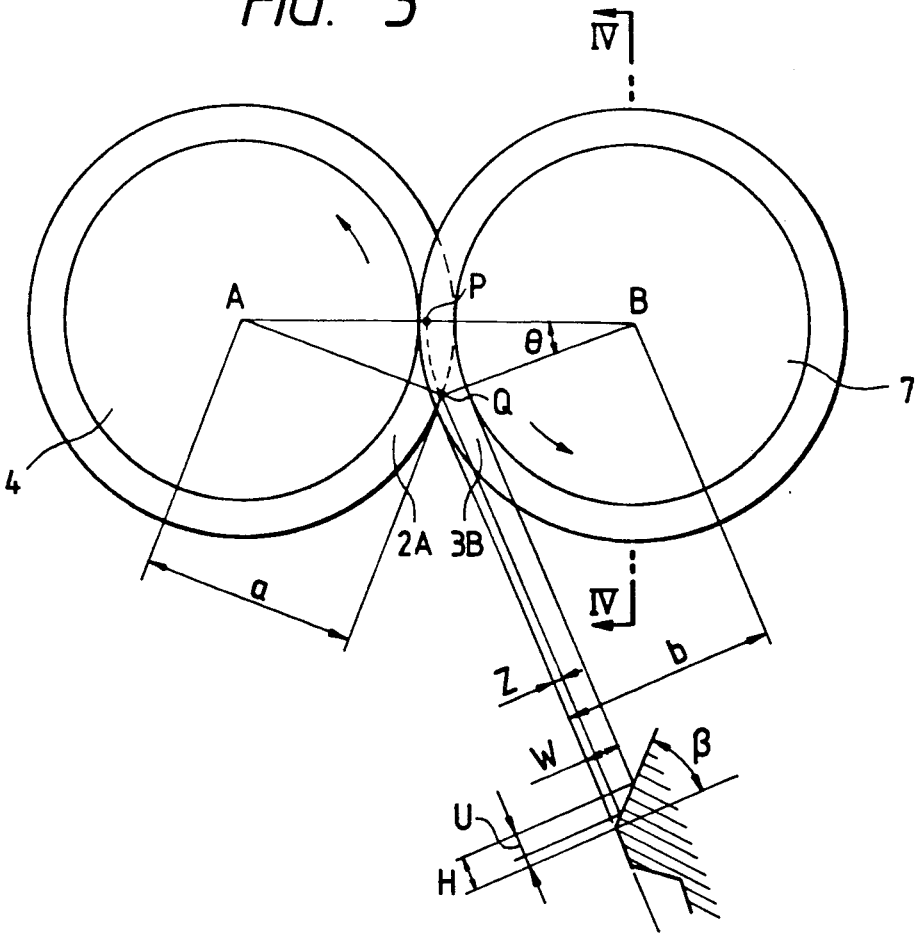
FIG. 3 is a schematic view showing the relationship of dimensions of helical threads and grooves of the rotors shown in FIG. 1.
Figure 4:
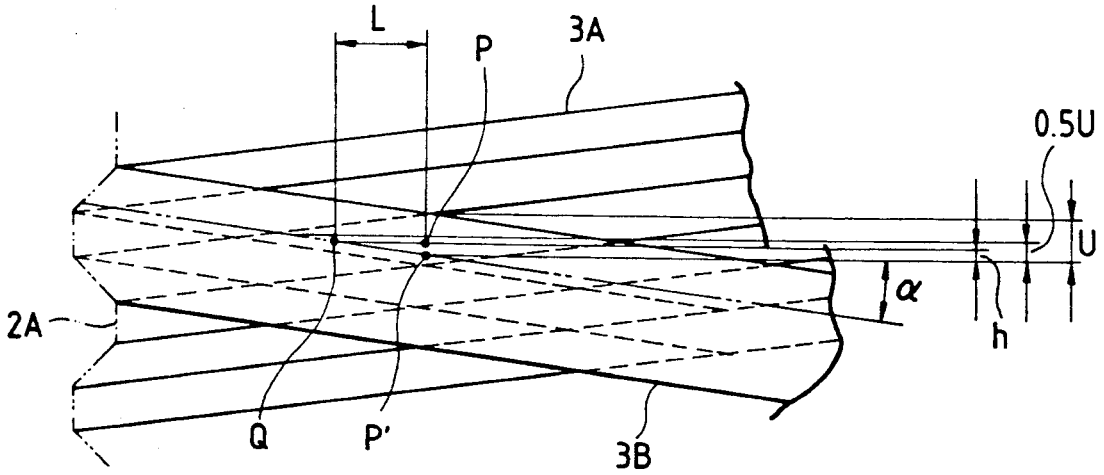
FIG. 4 is an enlarged fragmentary cross-sectional view taken along line IV—IV of FIG. 3, the view showing a helical groove and a helical thread received therein, as viewed from one of the rotors and linearly extended.

In order for the right-hand groove to receive the right-hand thread closely therein so that the rotors mesh closely with each other, it is necessary that the following conditions be satisfied: FIG. 3 shows that the bottom surface of the helical groove 2A of the rotor 4 and the top surface of the helical thread 3B of the rotor 4 are held in contact with other in the radial direction. FIG. 4 fragmentarily shows, at enlarged scale, the helical groove and the helical thread received therein, as viewed from the rotor 7 and linearly extended. Denoted in FIGS. 3 and 4 at A is the center of the rotor 4, B the center of the rotor 7, a the radius of the rotor 4, b the radius of the rotor 7, w the height of the thread, o the lead angle of the helical thread, and $\beta$ the flank angle of the helical thread.

When a point P on the flank of the thread of the rotor 7, at a radius (b−z) from the center B of the rotor 7, rotates to a point Q, the point P axially moves to a point P' by a distance h, which is given by:

$$h = L \times \tan \alpha$$

as shown in FIG. 4. L in the above equation represents an arc PQ in FIG. 3, and is expressed by $L = (b - z) \times \tan \theta$. From the triangle ABQ, the following equation is established:

$$\cos \theta = \{(a+b-w)^2 + (b-z)^2 - a^2\} / \{2 \times (a+b-w) \times (b-z)\}.$$

The axial dimension U of the point P' from the bottom of the helical groove is given by:

$$U = (w - z) \times \tan \beta.$$

If $0.5 \times U > h$ in FIG. 4, then the helical thread 3A of the rotor 4 and the helical thread 3B of the rotor 7 can rotate without physical interference with each other. Therefore, the flank angle $\beta$ which satisfies the following expression:

$$\tan \beta > 2 \times \{(b-z)/(w-z)\} \times \tan \alpha \times \arccos [\{(a+b-w)^2 + (b-z)^2 - a^2)\} / \{2 \times (a+b-w) \times (b-z)\}]$$

may be selected with respect to all values for z, ranging from z=0 to z=w.

Each of the rotors 4, 7 shown in FIG. 1 has a single helical thread for the sake of brevity. However, each of the rotors 4, 7 may have a plurality of helical threads and hence a plurality of helical grooves.

With the present invention, as described above, the gas in the helical grooves is moved by the rotation of the respective rotors and also forcibly moved by the helical threads of the opposite rotors without leaking through the radial gap between the bottom surfaces of the grooves and the top surfaces of the threads. Therefore, the gas can be discharged from the molecular drag pump at increased speed.

Although a certain preferred embodiment has been shown and described, it should be understood that many changes and modifications may be made therein without departing from the scope of the appended claims.

What is claimed is:

1. A molecular drag pump comprising:

a stationary housing having an inlet port and an exhaust port;

a pair of first and second rotors rotatably disposed in said stationary housing, said first and second rotors being rotatable about respective axes extending parallel to each other;

said first and second rotors having respective first and second helical threads and respective first and second helical grooves, which are helically inclined to said axes in one direction, said first and second rotors being held in mesh with each other with said first and second helical threads being received in said second and first grooves, respectively, said first and second helical threads having a flank angle such that said first and second helical threads are closely received in said second and first grooves while keeping the first and second threads out of contact with each other; and means in said stationary housing for rotating said first and second rotors in one direction about respective axes thereof to move a gas introduced through said inlet port toward said exhaust port axially along said first and second rotors;

wherein said flank angle is defined as $\beta$ according to the expression:

$$\tan \beta > 2 \times \{(b-z)/(w-z)\} \times \tan \alpha \times \arccos$$

$$[\{(a-b-w)^2+(b-z)^2-a^2)\}/\{2 \times (a+b-w) \times (b-z)\}]$$

where z is the radius of said first rotor, b the radius of the second rotor, w the height of said second helical thread, z the distance of a point on the flank of said second helical thread from the crest surface thereof, and $\alpha$ the lead angle of said second helical thread.

* * * * *